US009886929B2

(12) United States Patent
Xiong

(10) Patent No.: US 9,886,929 B2
(45) Date of Patent: Feb. 6, 2018

(54) DRIVING CIRCUIT

(71) Applicant: Shenzhen China Star Optoelectronics Technology Co., Ltd., Shenzhen, Guangdong (CN)

(72) Inventor: Zhi Xiong, Guangdong (CN)

(73) Assignee: Shenzhen China Star Optoelectroics Technology Co., Ltd., Shenzhen, Guangdong (CN)

( * ) Notice: Subject to any disclaimer, the term of this patent is extended or adjusted under 35 U.S.C. 154(b) by 211 days.

(21) Appl. No.: 14/785,852

(22) PCT Filed: Aug. 21, 2015

(86) PCT No.: PCT/CN2015/087798

§ 371 (c)(1),
(2) Date: Oct. 21, 2015

(87) PCT Pub. No.: WO2017/024610

PCT Pub. Date: Feb. 16, 2017

(65) Prior Publication Data

US 2017/0162163 A1 Jun. 8, 2017

(30) Foreign Application Priority Data

Aug. 10, 2015 (CN) ..... 2015 1 0485609

(51) Int. Cl.

| | |
|---|---|
| ***G09G 5/00*** | (2006.01) |
| ***G09G 3/36*** | (2006.01) |
| ***G09G 3/18*** | (2006.01) |
| ***G09G 5/18*** | (2006.01) |

(52) U.S. Cl.

CPC ..... *G09G 3/3685* (2013.01); *G09G 3/18* (2013.01); *G09G 5/008* (2013.01); *G09G 5/18* (2013.01); *G09G 2310/08* (2013.01); *G09G 2320/00* (2013.01)

(58) Field of Classification Search

CPC ..... G09G 3/18; G09G 3/3674

See application file for complete search history.

(56) References Cited

U.S. PATENT DOCUMENTS

| | | | | |
|---|---|---|---|---|
| 9,589,522 | B2 * | 3/2017 | Shin | G09G 3/3648 |
| 2015/0206491 | A1 * | 7/2015 | Cho | G09G 3/3688 345/96 |

* cited by examiner

*Primary Examiner* — Jeffrey Zweizig
(74) *Attorney, Agent, or Firm* — Andrew C. Cheng

(57) ABSTRACT

A timing control chip includes a pulse signal generation module for generating first and second pulse signals, a data signal sending module having a data signal including valid and invalid data segments, and a synthesis module for synthesizing the first and second pulse signals into the invalid data segment to form a synthesized data signal and then transfer it to the data signal sending module. The data signal sending module is to connect a data driver chip to make the data driver chip decompose the synthesized data signal into the first and the second pulse signal, grab a state of the second pulse signal when the first pulse signal is at a first edge and control a polarity of an outputted driving voltage according to the grabbed state of the second pulse signal. The invention further provides a data driver chip and a driving circuit.

10 Claims, 3 Drawing Sheets

DRIVING CIRCUIT

CROSS-REFERENCE TO RELATED APPLICATION

This application claims the priority of Chinese Patent Application No. 201510485609.7, entitled "Driving Circuit", filed on Aug. 10, 2015, the disclosure of which is incorporated herein by reference in its entirety.

TECHNICAL FIELD

The invention relates to the field of liquid crystal display, and particularly to a driving circuit.

DESCRIPTION OF RELATED ART

In the production process of liquid crystal, owing to no way to completely purify the liquid crystal, some mobile ions are brought thereinto. When a voltage is applied, the mobile ions would move towards an electrode because of being attracted by opposite polarity charges on the electrode. When the average value of the applied voltage is not zero, the ions would move towards one electrode until the interface of the liquid crystal and an alignment film and then be fixed. The ions being fixed on the interface of the liquid crystal and the alignment film would form an internal electric field together with the opposite polarity charges on the electrode, resulting in a transmittance-voltage curve is changed. If a liquid crystal panel is driven by a direct current (DC) voltage, when a static picture or a less-changed picture is displayed for a long time on the screen, even changing the content of the displaying picture, a phenomenon that previous picture traces still are seen on the liquid crystal screen would be occurred. This phenomenon is known as "direct current residual". Output pins of a scan driver chip are connected to gates of each row of thin film transistors so as to keep the turn-on times as well as the turn-off times of the each row of thin film transistors to be consistent. A timing control chip continuously outputs data signals to a data driver chip, if driving voltages are outputted at once when the data driver chip receives a set of data each time, it would cause an inconsistence of driving voltage output time of the data driver chip. In order to solve the direct current residual and the inconsistence of driving voltage time, pulse signals such as TP (load signal) and POL (polarity signal) signals are introduced into the timing control chip and the data driver chip in the industry. The introduction of the TP and POL signals for the timing control chip and the data driver chip would result in an increase in the pin number of the timing control chip and the data driver chip, the increase in costs of the two chips and meanwhile the increase of areas of printed circuit boards carrying the two chips.

SUMMARY

Accordingly, a technical problem to be solved by the invention is to provide a timing control chip, a data driver chip and a driving circuit, so as to reduce chip pin numbers, areas and costs of the timing control chip and the data driver chip and meanwhile decrease areas of printed circuit boards carrying the timing control chip and the data driver chip.

In order to achieve above-mentioned objectives, embodiments of the invention provide the following technical solutions:

The invention provides a timing control chip adapted for being applied to a driving circuit of a liquid crystal display device and connecting to a data driver chip of the driving circuit. The timing control chip includes:

- a pulse signal generation module, wherein the pulse signal generation module is configured (i.e., structured and arranged) for generating a first pulse signal and a second pulse signal;
- a data signal sending module, wherein the data signal sending module has a data signal, the data signal sending module includes data output pins, the data signal includes a valid data segment and an invalid data segment;
- a synthesis module, wherein the synthesis module is connected between the pulse signal generation module and the data signal sending module and configured for synthesizing the first pulse signal and the second pulse signal into the invalid data segment of the data signal to thereby form a synthesized data signal and further transferring the synthesized data signal to the data signal sending module; the first and second pulse signals and the valid data segment at least have a preset first time interval therebetween, the first pulse signal and the second pulse signal have a preset second time interval therebetween; data output pins of the data signal sending module are configured for connecting to the data driver chip to send the synthesized data signal to the data driver chip and making the data driver chip to decompose the synthesized data signal into the first pulse signal and the second pulse signal, grab a state of the second pulse signal when the first pulse signal is at a first edge and thereby control a polarity of an outputted driving voltage according to the grabbed state of the second pulse signal.

In one embodiment, the synthesis module includes a first synthesis unit and a second synthesis unit, the first synthesis unit and the second synthesis unit each are connected between the pulse signal generation module and the data signal sending module; the first synthesis unit is configured for synthesizing the first pulse signal into the data signal, the second synthesis unit is configured for synthesizing the second pulse signal into the data signal, and thereby forming the synthesized data signal.

In one embodiment, the first pulse signal and the second pulse signal have different duty ratios.

In one embodiment, the first pulse signal is TP signal, and the second pulse signal is POL signal.

In one embodiment, the data signal further includes a reset segment, the reset segment is located between the invalid data segment and the valid data segment.

In one embodiment, a first or a second pulse data connected with the reset segment and the reset segment have a preset third time interval therebetween.

The invention further provides a data driver chip adapted for being applied to a driving circuit of a liquid crystal display device and connecting to a timing control chip. The data driver chip includes:

- a data receiving module, wherein the data receiving module includes data receiving pins, the data receiving pins are configured for connecting to data output pins of the timing control chip to thereby receive a synthesized data signal outputted by the timing control chip, an invalid data segment of the synthesized data signal has a first pulse signal and a second pulse signal, the first and second pulse signals and a valid data segment of the synthesized data signal at least have a preset first time interval therebetween, and there is a second preset time interval between the first pulse signal and the second pulse signal;

a decomposition module, wherein the decomposition module is connected to the data receiving module and configured for decomposing the synthesized data signal to obtain the first pulse signal and the second pulse signal;

a voltage output control module, wherein the voltage output control module is connected to the decomposition module and configured for receiving the first pulse signal and the second pulse signal, grab a state of the second pulse signal when the first pulse signal is at a first edge and thereby control a polarity of an outputted driving voltage according to the grabbed state of the second pulse signal.

In one embodiment, the decomposition module includes a first decomposition unit and a second decomposition unit, the first decomposition unit and the second decomposition unit each are connected to the data receiving module; the first decomposition unit is configured for decomposing the synthesized data signal to obtain the first pulse signal, and the second decomposition unit is configured for decomposing the synthesized data signal to obtain the second pulse signal.

In one embodiment, the first pulse signal and the second pulse signal have different duty ratios.

In one embodiment, the first pulse signal is TP signal, and the second pulse signal is POL signal.

The invention still further provides a driving circuit adapted for being applied to a liquid crystal display device. The driving circuit includes:

a timing control chip including:

a pulse signal generation module, wherein the pulse signal generation module is configured for generating a first pulse signal and a second pulse signal;

a data signal sending module, wherein the data signal sending module has a data signal, the data signal sending module includes data output pins, the data signal includes a valid data segment and an invalid data segment;

a synthesis module, wherein the synthesis module is connected between the pulse signal generation module and the data signal sending module and configured for synthesizing the first pulse signal and the second pulse signal into the invalid data segment of the data signal to thereby form a synthesized data signal and further transferring the synthesized data signal to the data signal sending module; the first and second pulse signals and the valid data segment at least have a preset first time interval therebetween, the first pulse signal and the second pulse signal have a preset second time interval therebetween;

a data driver chip including:

a data receiving module, wherein the data receiving module includes data receiving pins, the data receiving pins are configured for connecting to data output pins of the timing control chip and receiving the synthesized data signal outputted by the timing control chip;

a decomposition module, wherein the decomposition module is connected to the data receiving module and configured for decomposing the synthesized data signal to obtain the first pulse signal and the second pulse signal;

a voltage output control module, wherein the voltage output control module is connected to the decomposition module and configured for receiving the first and second pulse signals, grabbing a state of the second pulse signal when the first pulse signal is at a first edge and thereby controlling a polarity of an outputted driving voltage according to the grabbed state of the second pulse signal.

In one embodiment, the synthesis module includes a first synthesis unit and a second synthesis unit, the first synthesis unit and the second synthesis unit each are connected between the pulse signal generation module and the data signal sending module; the first synthesis unit is configured for synthesizing the first pulse signal into the data signal, the second synthesis unit is configured for synthesizing the second pulse signal into the data signal, and thereby forming the synthesized data signal.

In one embodiment, the decomposition module includes a first decomposition unit and a second decomposition unit, the first decomposition unit and the second decomposition unit each are connected to the data receiving module; the first decomposition unit is configured for decomposing the synthesized data signal to obtain the first pulse signal, and the second decomposition unit is configured for decomposing the synthesized data signal to obtain the second pulse signal.

In one embodiment, the first pulse signal and the second pulse signal have different duty ratios.

In one embodiment, the first pulse signal is TP signal, and the second pulse signal is POL signal.

In one embodiment, the data signal further includes a reset segment, the reset segment is located between the invalid data segment and the valid data segment.

Sum up, the invention provides a timing control chip adapted for being applied to a driving circuit of a liquid crystal display device and connecting to a data driver chip of the driving circuit, the timing control chip includes a pulse signal generation module, a data signal sending module and a synthesis module. The pulse signal generation module is configured for generating a first pulse signal and a second pulse signal; the data signal sending module includes data output pins, the data signal includes a valid data segment and an invalid data segment; the synthesis module is connected between the pulse signal generation module and the data signal sending module and is configured for synthesizing the first and second pulse signals into the invalid data segment of the data signal to thereby form a synthesized data signal and transferring the synthesized data signal to the data signal sending module; the first and second pulse signals and the valid data segment at least have a preset first time interval therebetween, the first pulse signal and the second pulse signal have a preset second time interval therebetween; data output pins of the data signal sending module are configured for connecting to the data driver chip to send the synthesized data signal to the data driver chip and making the data driver chip to decompose the synthesized data signal into the first and second pulse signal, grab a state of the second pulse signal when the first pulse signal is at a first edge and thereby control the polarity of the outputted driving voltage according to the grabbed state of the second pulse signal. Therefore, compared with the conventional timing control chip, the timing control chip of the invention can reduce pulse signal output pins and thus can achieve the purpose of reducing the pin number of the timing control chip and reducing the area and the costs of the timing control chip, and thereby reducing the area of the printed circuit board carrying the timing control chip.

BRIEF DESCRIPTION OF THE DRAWINGS

In order to more clearly illustrate the technical solution of the invention, drawings will be used in the description of embodiments will be given a brief description below. Apparently, the drawings in the following description of embodiments only are some of embodiments of the invention, the ordinary skill in the art can obtain other drawings according to these illustrated drawings without creative effort.

DETAILED DESCRIPTION OF EMBODIMENTS

In the following, with reference to accompanying drawings of embodiments of the invention, technical solutions in embodiments of the invention will be clearly and completely described.

Figure 1:
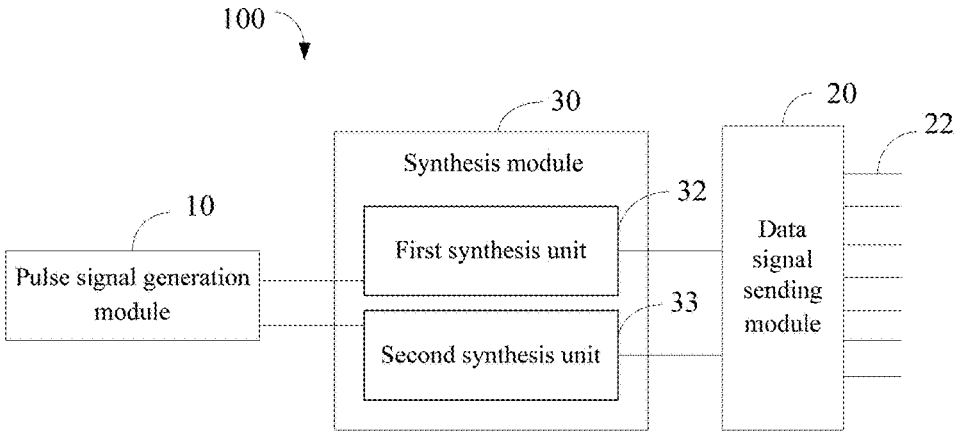
FIG. 1 is a block diagram of a timing control chip provided by a first embodiment of the invention.
Figure 2:
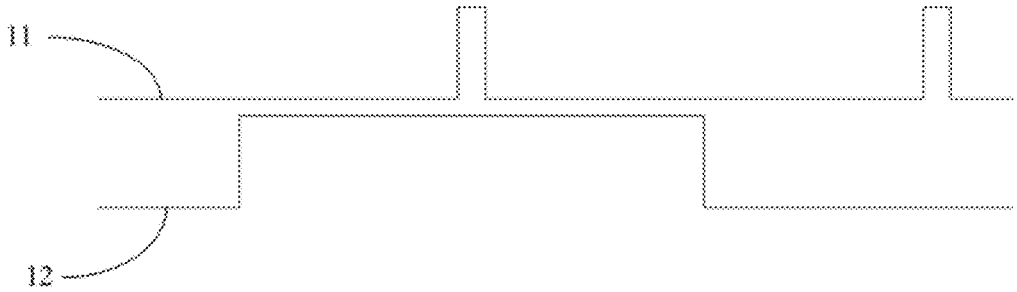
FIG. 2 is a waveform diagram of a first and second pulse signals produced by a pulse signal generation module in FIG. 1.
Figure 3:
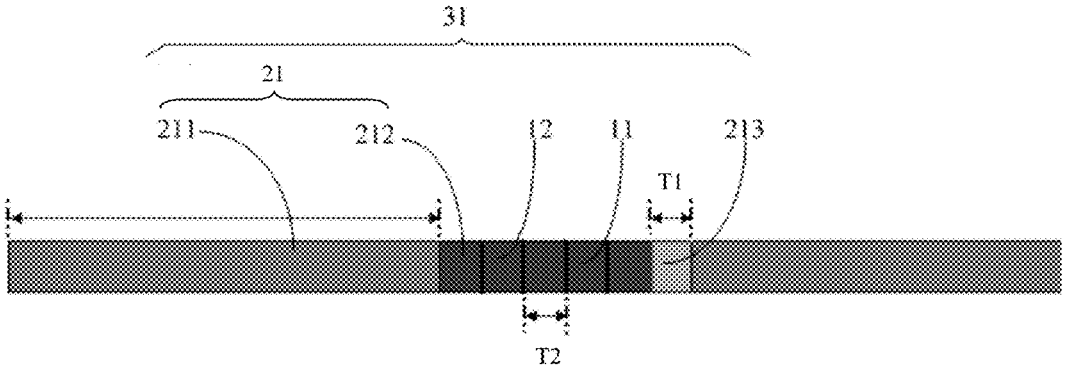
FIG. 3 is a schematic view of data segments of a synthesized data signal outputted by the timing control chip in FIG. 1.

Please referring to FIG. 1 through FIG. 3 together, a first embodiment of the invention provides a timing control chip 100. The timing control chip 100 is applied to a driving circuit of a liquid crystal display device to connect to a data driver chip of the driving circuit. The timing control chip 100 includes a pulse signal generation module 10, a data signal sending module 20 and a synthesis module 30.

The pulse signal generation module 10 is configured for generating a first pulse signal 11 and a second pulse signal 12.

In the present embodiment, the first pulse signal 11 is a TP signal. The second pulse signal 12 is a POL signal.

The data signal sending module 20 has a data signal. The data signal sending module 20 includes data output pins 22. The data output pins 22 are configured for outputting the data signal. The data signal includes a valid data segment 211 and an invalid data segment 212.

The synthesis module 30 is connected between the pulse signal generation module 10 and the data signal sending module 20 and is configured for synthesizing the first pulse signal 11 and the second pulse signal 12 into the invalid data segment 212 of the data signal so as to form a synthesized data signal 31 and transferring the synthesized data signal 31 to the data signal sending module 20. The first and second pulse signals 11, 12 and the data signal 211 at least have a preset first time interval T1 therebetween. There is a second preset time interval T2 between the first pulse signal 11 and the second pulse signal 12. The data output pins 22 of the data signal sending module 20 is configured for connecting to the data driver chip to thereby send the synthesized data signal 31 to the data driver chip, so as to make the data driver chip to decompose the synthesized data signal 31 into the first and the second pulse signals 11, 12, grab a state of the second pulse signal 12 when the first pulse signal 11 is at a first edge and control a polarity of an outputted driving voltage according to the grabbed state of the second pulse signal 12.

It is noted that, in the present embodiment, the first pulse signal 11 and the second pulse signal 12 have different duty ratios. The first edge of the first pulse signal 11 may be a rising edge. The data driver chip grabs the state of the second pulse signal 12 when the first pulse signal 11 is at the rising edge and control the polarity of the outputted driving voltage according to the grabbed state of the second pulse signal 12. The first and second pulse signals 11, 12 and the valid data segment 211 at least have the preset first time interval T1 therebetween so as to prevent from being mixed with the valid data of the valid data segment 211. A time interval between the nearest pulse signal in the first and second pulse signals 11, 12 distant from the valid data segment 211 and the valid data segment 211 is the preset first time interval T1.

In the present embodiment, the synthesis module 30 is connected between the pulse signal generation module 10 and the data signal sending module 20 and is configured for synthesizing the first and second pulse signals into the invalid data segment 212 of the data signal to thereby form the synthesized data signal 31 and transferring the synthesized data signal 31 to the data signal sending module 20. The first and second pulse signals 11, 12 and the valid data segment 211 have the preset first time interval T1 therebetween. There is the preset second time interval T2 between the first pulse signal 11 and the second pulse signal 12. The data output pins 22 of the data signal sending module 20 are configured for connecting to the data driver chip to transfer the synthesized data signal 31 to the data driver chip so as to make the data driver chip to decompose the synthesized data signal 31 into the first and the second pulse signals 11, 12, grab the state of the second pulse signal 12 when the first pulse signal 11 is at a first edge and thereby control a polarity of an outputted driving voltage according to the grabbed state of the second pulse signal 12. Therefore, compared with the conventional timing control chip, the timing control chip 100 can reduce the pulse signal output pins and thus can achieve the purposes of reducing the pin number of the timing control chip 100 and reducing the area and the cost of the timing control chip 100 and thereby reducing the area of the printed circuit board carrying the timing control chip 100.

Optionally, the synthesis module 30 includes a first synthesis unit 32 and a second synthesis unit 33. The first and the second synthesis units 32, 33 each are connected between the pulse signal generation module 10 and the data signal sending module 20. The first synthesis unit 32 is configured for synthesizing the first pulse signal 11 into the data signal 21, the second synthesis unit 33 is configured for synthesizing the second pulse signal 12 into the data signal 21, and thereby forming the synthesized data signal 31.

It is noted that, the first and the second pulse signals 11, 12 are synthesized into the data signal 21 by the first and the second synthesis units 32,33 respectively to thereby realize an independent control and provide a flexibility of synthesis.

Optionally, the data signal 21 further includes a reset segment 213. The reset segment 213 is located between the invalid data segment 212 and the valid data segment 211.

It is noted that, a function of the reset segment 213 is that: when the reset segment 213 is read, it means that the next data segment will be read is a valid data segment 211.

Figure 4:
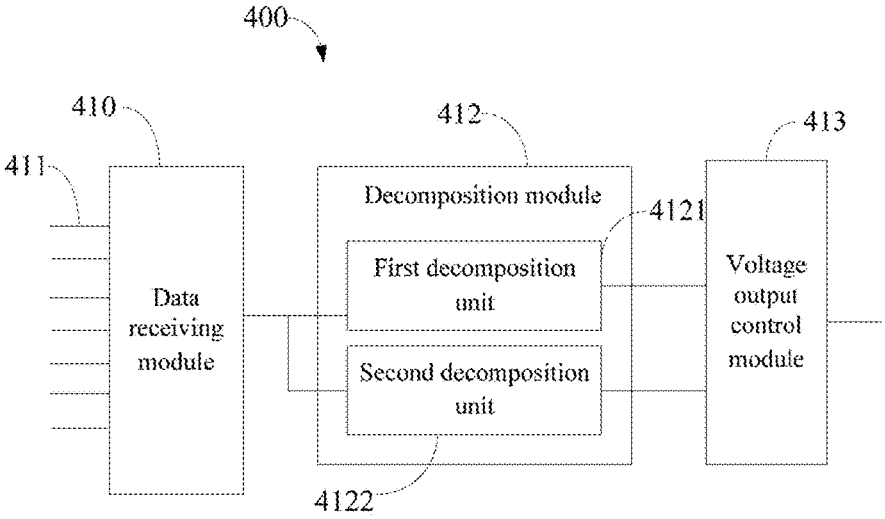
FIG. 4 is a block diagram of a data driver chip provided by a second embodiment of the invention.

Please referring to FIG. 4, a second embodiment of the invention provides a data driver chip 400. The data driver chip 400 is applied to a driving circuit of the liquid crystal display device to connect to the timing control chip 100. The data driver chip 400 includes a data receiving module 410, a decomposition module 412 and a voltage output control module 413.

The data receiving module 410 includes data receiving pins 411. The data receiving pins 411 are configured for connecting to the data output pins 22 of the timing control chip 100 to receive the synthesized data signal 31 outputted by the timing control chip 100. The invalid data segment 212 of the synthesized data signal 31 has the first pulse signal 11 and the second pulse signal 12. The first and second pulse signals 11, 12 and the valid data segment 212 at least have a preset first time interval T1 therebetween. The first pulse signal 11 and the second pulse signal 12 at least have a preset second time interval T2 therebetween.

The decomposition module 412 is connected to the data receiving module 410 and configured for decomposing the synthesized data signal 31 so as to obtain the first and second pulse signals 11, 12.

The voltage data control module 413 is connected to the decomposition module 412 and configured for receiving the first and second pulse signals 11, 12, grabbing a state of the second pulse signal 12 when the first pulse signal 11 is at the first edge and thereby controlling a polarity of an outputted driving voltage according to the grabbed state of the second pulse signal 12.

In the present embodiment, since the first and second pulse signals 11, 12 are synthesized into the data signal to form the synthesized data signal 31, the decomposition module 412 is connected to the data receiving module 410 and configured for decomposing the synthesized data signal 31 so as to obtain the first and the second pulse signals 11, 12. The voltage data control module 413 is connected to the decomposition module 412 and configured for receiving the first and the second pulse signals 11, 12, grabbing a state of the second pulse signal 12 when the first pulse signal 11 is at a first edge and thereby controlling the polarity of outputted driving voltage according to the grabbed state of the second pulse signal 12. Therefore, compared with the conventional data driver chip, the data driver chip 400 can reduce the number of pulse signal receiving pins and thus can achieve the purposes of reducing the pin number of the data driver chip 400 and reducing the area and the costs of the data driver chip 400, and thereby reducing the area of a printed circuit board carrying the data driver chip 400.

Optionally, the decomposition module 412 includes a first decomposition unit 4121 and a second decomposition unit 4122. The first and the second decomposition units 4121, 4122 each are connected to the data receiving module 410. The first decomposition unit 4121 is configured for decomposing the synthesized data signal 31 to obtain the first pulse signal 11. The second decomposition unit 4122 is configured for decomposing the synthesized data signal 31 to obtain the second pulse signal 12.

It is noted that, the first and the second pulse signals 11, 12 respectively are decomposed by the first and the second decomposition units 4121, 4122 so as to realize an independent control and provide a flexibility of synthesis.

Figure 5:
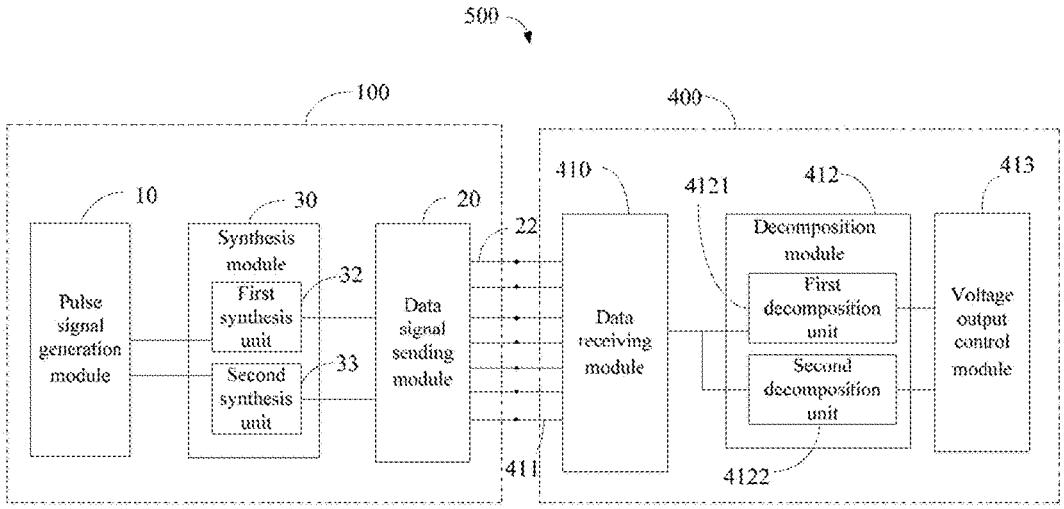
FIG. 5 is a block diagram of a driving circuit provided by a third embodiment of the invention.

Please referring to FIG. 5, a third embodiment of the invention provides a driving circuit 500. The driving circuit 500 is applied to a liquid crystal display device. The driving circuit 500 includes a timing control chip and a data driver chip. In the present embodiment, the timing control chip is the timing control chip 100 provided by the above-mentioned first embodiment. The data driver chip is the data driver chip 400 provided by the above-mentioned second embodiment. The timing control chip 100 is connected to the data receiving pins 411 of the data driver chip 400 by the data output pins 22 to thereby realize the connection between the timing control chip 100 and the data driver chip 400.

The structures and the functions of the timing control chip 100 and the data driver chip 400 have been illustrated in detail in the above-mentioned first and second embodiments, and thus they will not be repeated herein.

In the present embodiment, the synthesis module 30 is connected between the pulse signal generation module 10 and the data signal sending module 20 to synthesize the first and the second pulse signals into the invalid data segment 212 of the data signal so as to form the synthesized data signal 31 and then transfer the synthesized data signal 31 to the data receiving module 410 by the data output pins 22 and the data receiving pins 411 of the data driver chip 400. The decomposition module 412 is connected to the data receiving module 410 to decompose the synthesized data signal 31 so as to obtain the first and the second pulse signals 11, 12. The voltage data control module 413 is connected to the decomposition module 412 to receive the first and the second pulse signals 11, 12, grab the state of the second pulse signal 12 when the first pulse signal 11 is at the first edge and thereby control the polarity of the outputted driving voltage according to the grabbed state of the second pulse signal 12. Therefore, in the invention, compared with the conventional timing control chip, the timing control chip 100 reduces the pulse signal output pins, and compared with the conventional data driver chip, the data driver chip 400 reduces the pulse signal receiving pins, so that the purposes of reducing the pin numbers, the areas and the costs of the timing control chip 100 and the data driver chip 400 are achieved, and thus the areas of the printed circuit boards carrying the timing control chip 100 and the data driver chip 400 are reduced.

The foregoing discussion only is some preferred embodiments of the invention, it should be noted that, for ordinary skill in the art, under the premise of without departing from the principle of the invention, several modification and variations can be made, and these modifications and variations should be included in the protection scope of the invention.

What is claimed is:

1. A timing control chip adapted for being applied to a driving circuit of a liquid crystal display device and connecting to a data driver chip of the driving circuit; the timing control chip comprising:

a pulse signal generation module, wherein the pulse signal generation module is configured for generating a first pulse signal and a second pulse signal;

a data signal sending module, wherein the data signal sending module has a data signal, the data signal sending module comprises data output pins, the data signal comprises a valid data segment and an invalid data segment;

a synthesis module, wherein the synthesis module is connected between the pulse signal generation module and the data signal sending module and configured for synthesizing the first pulse signal and the second pulse signal into the invalid data segment of the data signal to thereby form a synthesized data signal and transferring the synthesized data signal to the data signal sending module, the first and second pulse signals and the valid data segment at least have a preset first time interval therebetween, the first pulse signal and the second pulse signal have a preset second time interval therebetween, data output pins of the data signal sending module are configured for connecting to the data driver chip to send the synthesized data signal to the data driver chip and thereby making the data driver chip to decompose the synthesized data signal into the first pulse signal and the second pulse signal, grab a state of the second pulse signal when the first pulse signal is at a first edge and control a polarity of an outputted driving voltage according to the grabbed state of the second pulse signal.

2. The timing control chip as claimed in claim 1, wherein the synthesis module comprises a first synthesis unit and a second synthesis unit, the first synthesis unit and the second synthesis unit each are connected between the pulse signal generation module and the data signal sending module; the first synthesis unit is configured for synthesizing the first pulse signal into the data signal, the second synthesis unit is configured for synthesizing the second pulse signal into the data signal, and thereby forming the synthesized data signal.

3. The timing control chip as claimed in claim 1, wherein the first pulse signal and the second pulse signal have different duty ratios.

4. The timing control chip as claimed in claim 1, wherein the first pulse signal is TP signal, and the second pulse signal is POL signal.

5. The driving circuit as claimed in claim 4, wherein the first pulse signal is TP signal, and the second pulse signal is POL signal.

6. The driving circuit as claimed in claim 1, wherein the data signal further comprises a reset segment, the reset segment is located between the invalid data segment and the valid data segment.

7. The driving circuit of a display panel as claimed in claim 6, wherein a first or a second pulse data connected with the reset segment and the reset segment have a preset third time interval therebetween.

8. A data driver chip adapted for being applied to a driving circuit of a liquid crystal display device and connecting to a timing control chip; the data driver chip comprising:

a data receiving module, wherein the data receiving module comprises data receiving pins, the data receiving pins are configured for connecting to data output pins of the timing control chip to receive a synthesized data signal outputted by the timing control chip, an invalid data segment of the synthesized data signal has a first pulse signal and a second pulse signal, the first and second pulse signals and a valid data segment of the synthesized data signal at least have a preset first time interval therebetween, the first pulse signal and the second pulse signal have a preset second time interval therebetween;

a decomposition module, wherein the decomposition module is connected to the data receiving module and configured for decomposing the synthesized data signal to obtain the first pulse signal and the second pulse signal;

a voltage output control module, wherein the voltage output control module is connected to the decomposition module and configured for receiving the first pulse signal and the second pulse signal, grabbing a state of the second pulse signal when the first pulse signal is at a first edge and controlling a polarity of an outputted driving voltage according to the grabbed state of the second pulse signal.

9. The driving circuit as claimed in claim 8, wherein the decomposition module comprises a first decomposition unit and a second decomposition unit, the first decomposition unit and the second decomposition unit each are connected to the data receiving module; the first decomposition unit is configured for decomposing the synthesized data signal to obtain the first pulse signal, and the second decomposition unit is configured for decomposing the synthesized data signal to obtain the second pulse signal.

10. The driving circuit as claimed in claim 8, wherein the first pulse signal and the second pulse signal have different duty ratios.

* * * * *